US008979481B2

(12) United States Patent
Ingram

(10) Patent No.: US 8,979,481 B2
(45) Date of Patent: Mar. 17, 2015

(54) TURBINE BUCKET ANGEL WING FEATURES FOR FORWARD CAVITY FLOW CONTROL AND RELATED METHOD

(75) Inventor: Clint Luigie Ingram, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 610 days.

(21) Appl. No.: 13/282,097

(22) Filed: Oct. 26, 2011

(65) Prior Publication Data

US 2013/0108441 A1 May 2, 2013

(51) Int. Cl.

| | |
|---|---|
| ***F03B 11/00*** | (2006.01) |
| ***F01D 11/04*** | (2006.01) |
| ***F01D 11/00*** | (2006.01) |

(52) U.S. Cl.

CPC ..... *F01D 11/04* (2013.01); *F01D 11/001* (2013.01)

USPC ..... 415/115; 415/173.7; 416/97 R

(58) Field of Classification Search

CPC .... F01D 11/001; F01D 11/04; F05D 2240/81

USPC ..... 415/97 R, 179, 189, 193 A, 193 R, 239; 416/115, 173.7, 174.5

See application file for complete search history.

(56) References Cited

U.S. PATENT DOCUMENTS

| | | | | |
|---|---|---|---|---|
| 6,506,016 | B1 | 1/2003 | Wang | |
| 7,114,339 | B2 | 10/2006 | Alvanos et al. | |
| 7,465,152 | B2 | 12/2008 | Nigmatulin | |
| 7,500,824 | B2 | 3/2009 | Cheng | |
| 7,665,964 | B2 | 2/2010 | Taylor et al. | |
| 8,057,178 | B2 * | 11/2011 | Itzel et al. | 416/97 R |
| 8,753,070 | B2 * | 6/2014 | Elorza Gomez | 415/115 |
| 2005/0100437 | A1 * | 5/2005 | Phillips et al. | 415/115 |
| 2011/0243749 | A1 * | 10/2011 | Praisner et al. | 416/223 A |

FOREIGN PATENT DOCUMENTS

| | | | | |
|---|---|---|---|---|
| GB | 2119027 A | * | 11/1983 | F01D 11/02 |
| WO | WO 2012/028424 A1 | * | 3/2012 | F01D 5/08 |

* cited by examiner

*Primary Examiner* — Dwayne J White
*Assistant Examiner* — Jason Fountain
(74) *Attorney, Agent, or Firm* — Nixon & Vanderhye P.C.

(57) ABSTRACT

A turbine bucket includes a radially inner mounting portion, a shank radially outward of the mounting portion, a radially outer airfoil and a substantially planar platform radially between the shank, and the airfoil. At least one axially-extending angel wing seal flange is formed on a leading end of the shank forming a circumferentially extending trench cavity along the leading edge of the shank, radially between an underside of the platform leading edge and the angel wing seal flange. A plurality of substantially radially-extending purge air holes are formed in the angel wing seal flange, adapted to fluidly connect a turbine rotor wheel space cavity with the trench cavity and thereby supply purge air to the outer surface of the angel wing seal flange.

19 Claims, 4 Drawing Sheets

TURBINE BUCKET ANGEL WING FEATURES FOR FORWARD CAVITY FLOW CONTROL AND RELATED METHOD

BACKGROUND OF THE INVENTION

The present invention relates generally to rotary machines and, more particularly, to the control of forward wheel space cavity purge flow and combustion gas flow at the leading angel wing seals on a gas turbine bucket.

A typical turbine engine includes a compressor for compressing air that is mixed with fuel. The fuel-air mixture is ignited in a combustor to generate hot, pressurized combustion gases in the range of about 1100° C. to 2000° C. that expand through a turbine nozzle, which directs the flow to high and low-pressure turbine stages thus providing additional rotational energy to, for example, drive a power-producing generator.

More specifically, thermal energy produced within the combustor is converted into mechanical energy within the turbine by impinging the hot combustion gases onto one or more bladed rotor assemblies. Each rotor assembly usually includes at least one row of circumferentially-spaced rotor blades or buckets. Each bucket includes a radially outwardly extending airfoil having a pressure side and a suction side. Each bucket also includes a dovetail that extends radially inward from a shank extending between the platform and the dovetail. The dovetail is used to mount the bucket to a rotor disk or wheel.

As known in the art, the rotor assembly can be considered as a portion of a stator-rotor assembly. The rows of buckets on the wheels or disks of the rotor assembly and the rows of stator vanes on the stator or nozzle assembly extend alternately across an axially oriented flowpath for the combustion gases. The jets of hot combustion gas leaving the vanes of the stator or nozzle act upon the buckets, and cause the turbine wheel (and rotor) to rotate in a speed range of about 3000-15,000 rpm, depending on the type of engine.

As depicted in the figures described below, an axial/radial opening at the interface between the stationary nozzle and the rotatable buckets at each stage can allow hot combustion gas to exit the hot gas path and enter the cooler wheelspace of the turbine engine located radially inward of the buckets. In order to limit this leakage of hot gas, the blade structure typically includes axially projecting angel wing seals. According to a typical design, the angel wings cooperate with projecting segments or "discouragers" which extend from the adjacent stator or nozzle element. The angel wings and the discouragers overlap (or nearly overlap), but do not touch each other, thus restricting gas flow. The effectiveness of the labyrinth seal formed by these cooperating features is critical for limiting the undesirable ingestion of hot gas into the wheelspace radially inward of the angel wing seals.

As alluded to above, the leakage of the hot gas into the wheelspace by this pathway is disadvantageous for a number of reasons. First, the loss of hot gas from the working gas stream causes a resultant loss in efficiency and thus output. Second, ingestion of the hot gas into turbine wheelspaces and other cavities can damage components which are not designed for extended exposure to such temperatures.

One well-known technique for reducing the leakage of hot gas from the working gas stream involves the use of cooling air, i.e., "purge air", as described in U.S. Pat. No. 5,224,822 (Lenehan et al). In a typical design, the air can be diverted or "bled" from the compressor, and used as high-pressure cooling air for the turbine cooling circuit. Thus, the cooling air is part of a secondary flow circuit which can be directed generally through the wheelspace cavities and other inboard rotor regions. This cooling air can serve an additional, specific function when it is directed from the wheel-space region into one of the angel wing gaps described previously. The resultant counter-flow of cooling air into the gap provides an additional barrier to the undesirable flow of hot gas through the gap and into the wheelspace region.

While cooling air from the secondary flow circuit is very beneficial for the reasons discussed above, there are drawbacks associated with its use as well. For example, the extraction of air from the compressor for high pressure cooling and cavity purge air consumes work from the turbine, and can be quite costly in terms of engine performance. Moreover, in some engine configurations, the compressor system may fail to provide purge air at a sufficient pressure during at least some engine power settings. Thus, hot gases may still be ingested into the wheelspace cavities.

Angel wings as noted above, are employed to establish seals upstream and downstream sides of a row of buckets and adjacent stationary nozzles. Specifically, the angel wing seals are intended the prevent the hot combustion gases from entering the cooler wheelspace cavities radially inward of the angel wing seals and, at the same time, prevent or minimize the egress of cooling air in the wheelspace cavities to the hot gas stream. Thus, with respect to the angel wing seal interface, there is a continuous effort to understand the flow patterns of both the hot combustion gas stream and the wheelspace cooling or purge air.

For example, it has been determined that even if the angel wing seal is effective and preventing the ingress of hot combustion gases into the wheelspaces, the impingement of combustion gas flow vortices on the surface of the seal may damage the seal and shorten the service life of the bucket.

The present invention seeks to provide unique angel wing seal and/or bucket platform geometry to better control the flow of secondary purge air at the angel wing interface to thereby also control the flow of combustion gases at that interface in a manner that extends the service life of the angel wing seal and hence the bucket itself.

BRIEF SUMMARY OF THE INVENTION

In one exemplary but nonlimiting embodiment, the invention provides a turbine bucket comprising a radially inner mounting portion, a shank radially outward of the mounting portion, a radially outer airfoil and a substantially planar platform radially between the shank and the airfoil; at least one axially-extending angel wing seal flange on a leading end of the shank forming a circumferentially extending trench cavity along the leading end of the shank, radially between an underside of a platform leading edge and the angel wing seal flange; and a plurality of substantially radially-extending purge air holes formed in the angel wing seal flange, adapted to fluidly connect a turbine rotor wheel space cavity with the trench cavity and thereby supply purge air to the outer surface of the angel wing seal flange.

In another aspect, the invention provides a turbine wheel supporting a circumferentially arranged row of buckets, each bucket comprising a radially inner mounting portion, a shank radially outward of the mounting portion, at least one radially outer airfoil and a substantially planar platform radially between the shank and the airfoil; at least one axially-extending angel wing seal flange on a leading end of the shank forming a circumferentially extending trench cavity along the leading end of the shank, radially between an underside of a platform leading edge and the angel wing seal flange; and wherein a plurality of substantially radially-extending purge air holes are formed in said angel wing seal flange, adapted to connect a turbine rotor wheel space cavity with said trench cavity.

In still another aspect, method of controlling secondary flow at a radial gap between a rotating turbine disk mounting a plurality of buckets and an adjacent nozzle, the method comprising: locating at least one angel wing seal on a leading edge of each of the plurality of buckets extending axially toward the nozzle to thereby form a barrier between a hot stream of combustion gases on a radially outer side of the angel wing seal and purge air in a wheel space radially inward of the at least one angel wing seal; and providing plural openings in the angel wing seal enabling purge air to flow into an area radially outward of the angel wing seal to thereby prevent the combustion gases from impinging on the angel wing seal flange.

The invention will now be described in detail in connection with the drawings identified below.

DETAILED DESCRIPTION OF THE INVENTION

Figure 1:
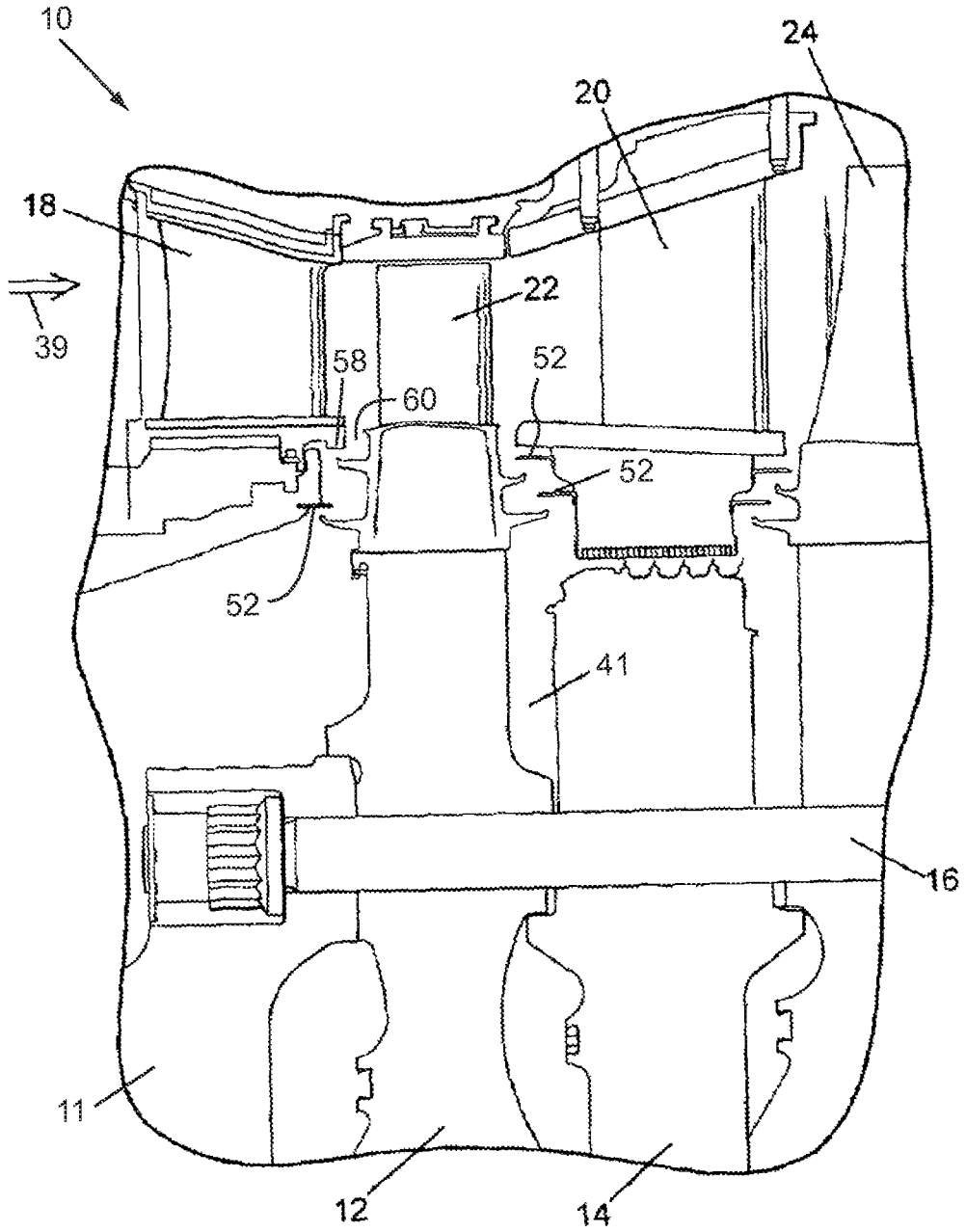
FIG. 1 (PRIOR ART)
FIG. 1 is a is a fragmentary schematic illustration of a cross-section of a portion of a turbine.

FIG. 1 schematically illustrates a section of a gas turbine, generally designated 10, including a rotor 11 having axially spaced rotor wheels 12 and spacers 14 joined one to the other by a plurality of circumferentially spaced, axially-extending bolts 16. Turbine 10 includes various stages having nozzles, for example, first-stage nozzles 18 and second-stage nozzles 20 having a plurality of circumferentially-spaced, stationary stator blades. Between the nozzles and rotating with the rotor and rotor wheels 12 are a plurality of rotor blades, e.g., first and second-stage rotor blades or buckets 22 and 24, respectively.

Figure 2:
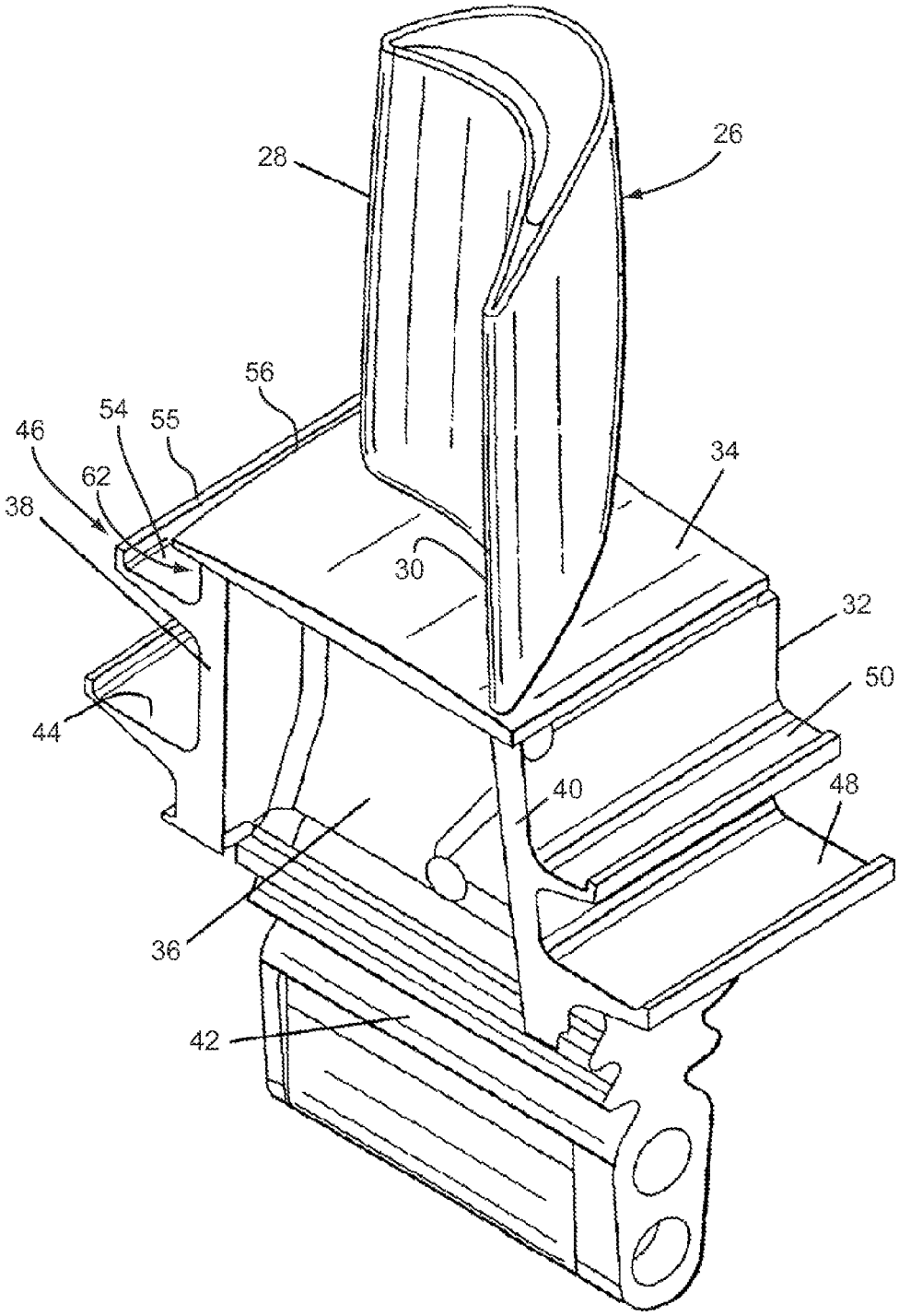
FIG. 2 (PRIOR ART)
FIG. 2 is an enlarged perspective view of a turbine blade.

Referring to FIG. 2, each bucket (for example, bucket 22 of FIG. 1) includes an airfoil 26 having a leading edge 28 and a trailing edge 30, mounted on a shank 32 including a platform 34 and a shank pocket 36 having integral cover plates 38, 40. A dovetail 42 is adapted for connection with generally corresponding dovetail slots formed on the rotor wheel 12 (FIG. 1). Bucket 22 is typically integrally cast and includes axially projecting angel wing seals 44, 46 and 48, 50. Seals 44, 46, 48 and 50 cooperate with lands 52 (see FIG. 1) formed on the adjacent nozzles to limit ingestion of the hot gases flowing through the hot gas path, generally indicated by the arrow 39 (FIG. 1), from flowing into wheel spaces 41.

Of particular concern here is the upper or radially outer angel wing seal 46 on the leading edge end of the bucket. Specifically, the angel wing 46 includes a longitudinal extending wing or seal flange 54 with an upturned edge 55. The platform leading edge 56 on the bucket 22 extends axially beyond the cover plate 38, toward the adjacent nozzle 18. The upturned edge 55 of seal flange 54 is in close proximity to the surface 58 of the nozzle 18 thus creating a tortuous or serpentine radial gap 60 as defined by the angel wing seal flanges 44, 46 and the adjacent nozzle surface 58 where combustion gas and purge air meet (see FIG. 1). In addition, the seal flange 54 upturned edge 55 and the platform leading edge 56 of platform 34 form a so-called "trench cavity" 62 where cooler purge air escaping from the wheel space interfaces with the hot combustion gases. As described further below, by maintaining cooler temperatures within the trench cavity 62, service life of the angel wing seals, and hence the bucket itself, can be extended.

In this regard, the rotation of the rotor, rotor wheel and buckets create a natural pumping action of wheel space purge air (secondary flow) in a radially outward direction, thus forming a barrier against the ingress of the higher temperature combustion gases (primary flow). At the same time, CFD analysis has shown that the strength of a so-called "bow wave," i.e., the higher pressure combustion gases at the leading edge 28 of the bucket airfoil 26, is significant in terms of controlling primary and secondary flow at the trench cavity. In other words, the higher temperature and pressure combustion gases attempting to pass through the gap 60 is strongest at the platform edge 56, adjacent the leading edge 28 of the bucket. As a result, during rotation of the wheel, a circumferentially-undulating pattern of higher pressure combustion gas flow is established about the periphery of the rotor wheel, with peak pressures substantially adjacent each the leading edge 28.

As discussed above, the radially outer angel wing seal flange 54 is intended to block or at least substantially inhibit hot combustion gases from entering the wheel space cavity, noting the close proximity between the radially outer seal wing flange 54 and the fixed nozzle surface 58, best seen in FIG. 1. The invention here provides a modification to the radially outer angel wing seal flange 54 that allows purge air from the radially inner turbine wheelspace to prevent the hot combustion gas flow from impinging on the seal flange, thus reducing the flange temperature and extending the service life of the flange and hence the bucket.

Figure 3:
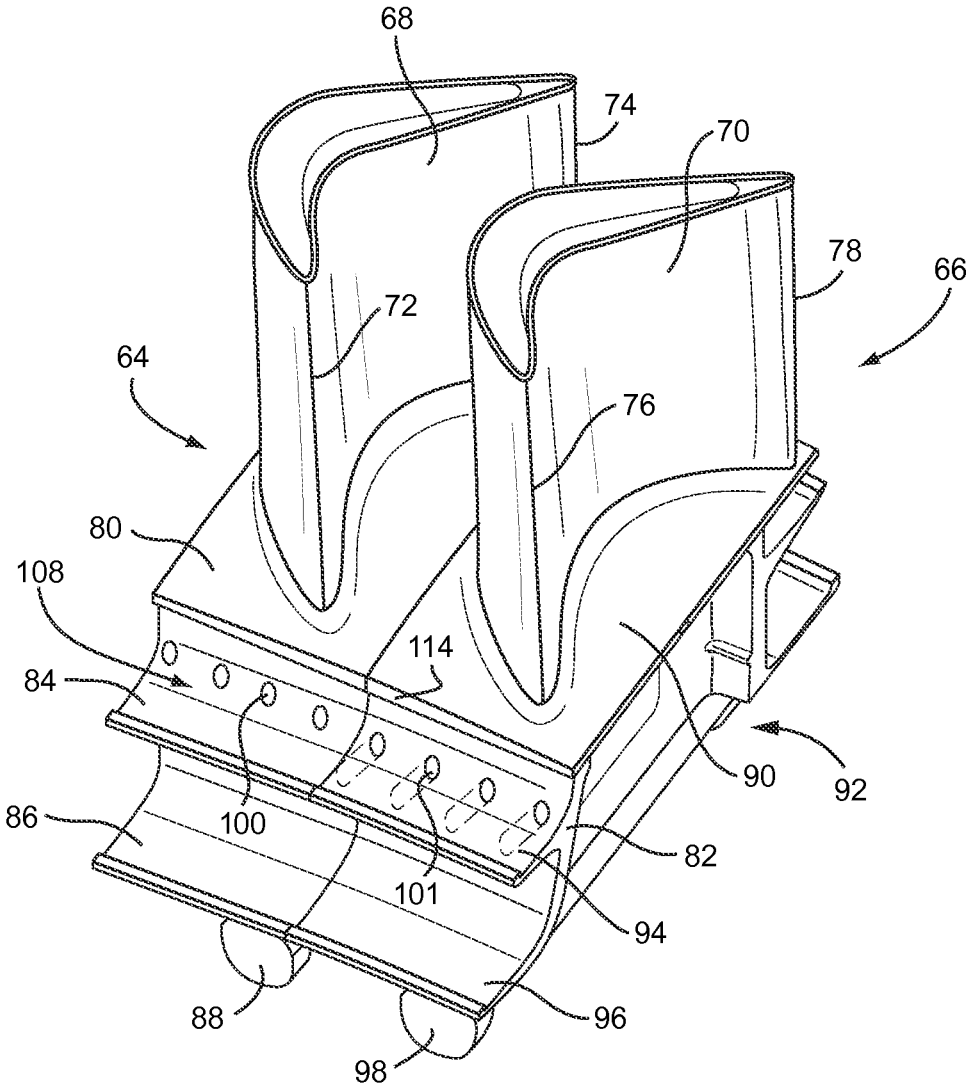
FIG. 3 is a perspective view of a pair of buckets with leading end angel wing seal flanges in accordance with an exemplary but nonlimiting embodiment of the invention.

As best seen in FIG. 3, a pair of buckets 64, 66 is arranged in side-by-side relationship and include airfoils 68, 70 with leading and trailing edges 72, 74 and 76, 78 respectively. The bucket 64 is also formed with a platform 80, shank 82 supporting inner and outer angel wing seal flanges 84, 86 at the leading end of the bucket, and a dovetail 88. Similarly, the bucket 66 is formed with a platform 90, shank 92 supporting angel wing seal flanges 94, 96 and a dovetail 98. Similar angel wing seals are provided on the trailing sides or ends of the buckets but are no of concern here.

Figure 4:
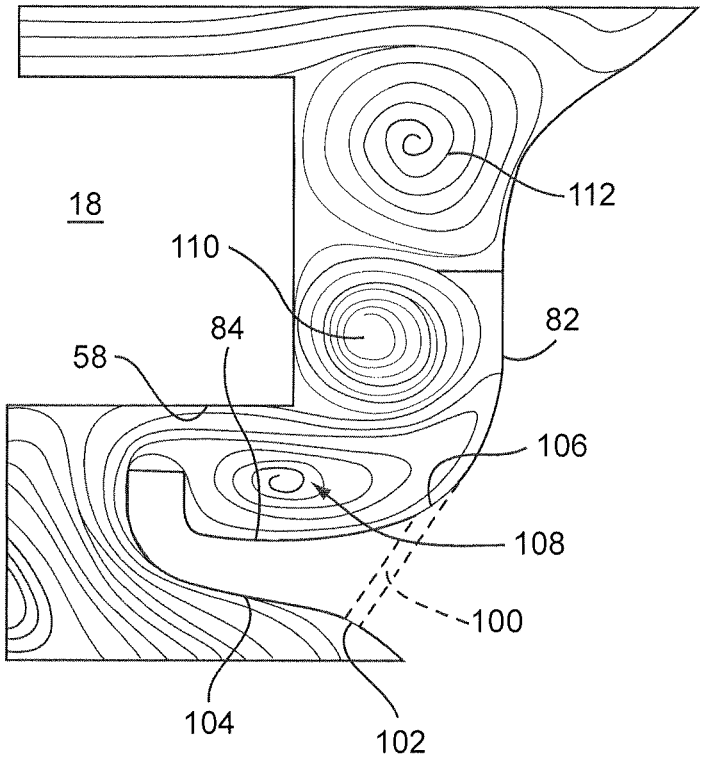
FIG. 4 is a partial schematic end view of a bucket with a leading end angel wing seal flange as shown in FIG. 3 and illustrating purge air combustion gas vortices at the seal flange.

Recognizing that buckets 64 and 66 are identical, only one need be described below. Accordingly, referencing the bucket 66, a plurality of purge air holes 100 are drilled or otherwise formed in the angel wing seal flange 94 in the area where the flange 94 is joined to the bucket shank 82. With reference also to FIG. 4, the purge air holes 100 extend angularly through the flange 94 from an inlet 102 on the underside surface 104 of the seal flange 94 to an outlet 106 at the interface between the outer surface of the seal flange 94 and the shank 82. The location of the outlet 106 is chosen to enhance the natural disk pumping phenomenon described above, fostering a stronger counterclockwise swirl or vortex of cooler purge air flow in the trench cavity 108 formed along the angel wing seal flange 94. As shown in FIG. 4, the resulting purge air vortices 110 are sufficiently strong to push the oppositely swirling hot combustion gas vortices 112 away from the angel wing seal flange 94.

The number of purge air holes 100 per bucket angel wing seal flange may vary, and the pattern of holes 100 may vary as well. For example, a non-uniform pattern may be equally or more effective than a uniform pattern if the locations of the holes 100 are targeted to just those areas along the substantially straight leading edge 114 of the bucket platform adjacent the leading edges 72, 76 of the airfoils 68, 70 that have been identified as having the highest combustion gas static pressure. In addition, the purge air holes 100 slant toward the shank, but may also slant in a circumferential direction to induce a substantial tangential swirl in the purge air vortices.

It will also be appreciated that the incorporation of purge air holes in the leading end angel wing seal flanges is compatible with other angel wing or bucket platform features that are designed to provide secondary flow (purge air flow) control in the forward wheel space cavities of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket comprising:

a radially inner mounting portion, a shank radially outward of the mounting portion, a radially outer airfoil and a substantially planar platform radially between the shank and the airfoil;

at least one axially-extending angel wing seal flange on a leading end of the shank forming a circumferentially extending trench cavity along the leading end of the shank, radially between an underside of a platform leading edge and the angel wing seal flange; and a plurality of substantially radially-extending purge air holes formed in said angel wing seal flange, adapted to fluidly connect a turbine rotor wheel space cavity with said trench cavity and thereby supply purge air to an outer surface of said angel wing seal flange, said purge air holes are distributed along an entire length of said angel wing seal flange.

2. The turbine bucket of claim 1 wherein said plurality of substantially radially-extending purge air holes have outlets located closely adjacent an interface between said angel wing seal flange and said shank.

3. The turbine bucket of claim 1 wherein said plurality of substantially radially-extending purge air holes are slanted axially toward said shank.

4. The turbine bucket of claim 3 wherein said plurality of substantially radially-extending purge air holes are slanted in a circumferential direction.

5. The turbine bucket of claim 1 wherein said plurality of substantially radially-extending purge air holes are substantially uniformly distributed in a circumferential direction.

6. The turbine bucket of claim 2 wherein said plurality of substantially radially-extending purge air holes are substantially uniformly distributed in a circumferential direction.

7. The turbine bucket of claim 1 wherein said plurality of substantially radially-extending purge air holes are substantially non-uniformly distributed in a circumferential direction.

8. The turbine bucket of claim 2 wherein said plurality of substantially radially-extending purge air holes are substantially non-uniformly distributed in a circumferential direction.

9. The turbine bucket of claim 2 wherein said plurality of substantially radially-extending purge air holes are slanted toward said shank in a radially-outward direction, and also slanted in a circumferential direction.

10. The turbine bucket of claim 1 wherein said platform is formed with a substantially straight leading edge.

11. A turbine wheel supporting a circumferentially arranged row of buckets, each bucket comprising:

a radially inner mounting portion, a shank radially outward of the mounting portion, at least one radially outer airfoil and a substantially planar platform radially between the shank and the airfoil;

at least one axially-extending angel wing seal flange on a leading end of the shank forming a circumferentially extending trench cavity along the leading end of the shank, radially between an underside of a platform leading edge and the angel wing seal flange;

and wherein a plurality of substantially radially-extending purge air holes are formed in said angel wing seal flange, adapted to connect a turbine rotor wheel space cavity with said trench cavity, said purge air holes are distributed along an entire length of said angel wing seal flange.

12. The turbine wheel of claim 11 wherein said plurality of substantially radially-extending purge air holes are located closely adjacent an interface between said angel wing seal flange and said shank.

13. The turbine wheel of claim 11 wherein said plurality of said substantially radially-extending purge air holes are axially slanted toward said shank.

14. The turbine wheel of claim 13 wherein said plurality of purge air holes are slanted in a circumferential direction.

15. The turbine wheel of claim 11 wherein said plurality of cooling holes are substantially uniformly distributed in a circumferential direction.

16. The turbine wheel of claim 11 wherein said plurality of substantially radially-extending purge air holes are axially slanted toward said shank in a radially-outward direction and also slanted in a circumferential direction.

17. The turbine wheel of claim 11 wherein said platform is formed with a substantially straight leading edge.

18. A method of controlling secondary flow at a radial gap between a rotating turbine disk mounting a plurality of buckets and an adjacent nozzle, the method comprising:

locating at least one angel wing seal on a leading end of each of said plurality of buckets extending axially toward said nozzle to thereby form a barrier between a hot stream of combustion gases on a radially outer side of said angel wing seal and purge air in a wheel space radially inward of said at least one angel wing seal; and providing plural openings in said angel wing seal enabling purge air to flow into an area radially outward of said angel wing seal flange to thereby prevent the combustion gases from impinging on said angel wing seal flange, wherein said plural openings are adapted to connect a turbine rotor wheel space cavity with said trench cavity, and said plural openings are distributed along an entire length of said angel wing seal.

19. The method of claim 18 wherein said plural openings are slanted axially toward said bucket in a radially outward direction and also slanted in a circumferential direction.

* * * * *